US007722424B2

(12) United States Patent
Shinozaki

(10) Patent No.: US 7,722,424 B2
(45) Date of Patent: May 25, 2010

(54) ELECTRON EMITTER, METHOD OF MANUFACTURING ELECTRON EMITTER, ELECTRO-OPTICAL DEVICE, AND ELECTRONIC APPARATUS

(75) Inventor: Junichiro Shinozaki, Chino (JP)

(73) Assignee: Seiko Epson Corporation (JP)

( * ) Notice: Subject to any disclaimer, the term of this patent is extended or adjusted under 35 U.S.C. 154(b) by 873 days.

(21) Appl. No.: 11/301,755

(22) Filed: Dec. 13, 2005

(65) Prior Publication Data

US 2006/0148369 A1 Jul. 6, 2006

(30) Foreign Application Priority Data

Jan. 5, 2005 (JP) ..... 2005-000436

(51) Int. Cl.
*H01J 9/04* (2006.01)

(52) U.S. Cl. ..... 445/50; 445/51; 313/310; 313/495

(58) Field of Classification Search ..... 445/49–51; 313/309–311, 495–497
See application file for complete search history.

(56) References Cited

U.S. PATENT DOCUMENTS

| | | | | |
|---|---|---|---|---|
| 7,410,905 | B2 | 8/2008 | Ushiyama et al. | |
| 2002/0013113 | A1* | 1/2002 | Onishi et al. | 445/6 |
| 2002/0068496 | A1* | 6/2002 | Onishi et al. | 445/6 |
| 2002/0180342 | A1* | 12/2002 | Yamada et al. | 313/493 |
| 2005/0043186 | A1 | 2/2005 | Maekawa et al. | |
| 2005/0074963 | A1* | 4/2005 | Fujii et al. | 438/623 |

FOREIGN PATENT DOCUMENTS

| | | |
|---|---|---|
| JP | 09-213210 | 8/1997 |
| JP | 2000-251667 | 9/2000 |
| JP | 2000-251671 | 9/2000 |
| JP | 2002-313221 | 10/2002 |
| JP | 2003-086087 | 3/2003 |
| JP | 2004-192811 | 7/2004 |
| JP | 2004-096451 | 11/2004 |
| KR | 2004-0103345 | 12/2004 |

OTHER PUBLICATIONS

Machine translation of jp 2000-251667 which is cited in the IDS filed on Oct. 11, 2007.*
Communication from Korean Patent Office regarding counterpart application.

* cited by examiner

*Primary Examiner*—Bumsuk Won
(74) *Attorney, Agent, or Firm*—Harness, Dickey & Pierce, P.L.C.

(57) ABSTRACT

There are provided an electron emitter of which deviation in electron emission characteristic is small, a method of manufacturing the electron emitter, and an electro-optical device and an electronic apparatus having the electron emitter. The method of manufacturing an electron emitter, in which electrons are emitted from an electron emission portion formed in a conductive film, comprises forming the conductive film in a pattern on a substrate by the use of a droplet jetting method; selectively removing a part of the conductive film; and forming the electron emission portion in the conductive film.

2 Claims, 9 Drawing Sheets

ELECTRON EMITTER, METHOD OF MANUFACTURING ELECTRON EMITTER, ELECTRO-OPTICAL DEVICE, AND ELECTRONIC APPARATUS

BACKGROUND

1. Technical Field

The present invention relates to an electron emitter, a method of manufacturing the electron emitter, and an electro-optical device and an electronic apparatus having the electron emitter.

2. Related Art

In the past, as electron emitters, there were known a thermal electron emission type and a cold-cathode electron emission type. As the electron emitters of the cold-cathode electron emission type, there were known a field emission type that electrons are emitted by an electric field and a surface conduction type that electrons are emitted from a conduction band of an electrode surface by allowing current to flow in the electrode.

As the electron emitter of the surface conduction type among them, there is known an electron emitter in which an electron emission portion is formed through an electrification forming process. Through the electrification forming process, a conductive thin film is destroyed locally to form a micro crack (narrow gap) destroyed locally. In this state, the electron emission portion is embodied by using the property that electrons with vacuum level are leaked from the micro crack when current is allowed to flow in the conductive thin film (for example, see JP A-9-213210).

The conductive thin film of the electron emitter according to Patent Document 1 is formed by the use of a so-called droplet jetting method (inkjet method). In this method, the conductive film is formed by applying a functional solution containing a conductive material in a pattern onto a substrate by the use of the droplet jetting method and then removing a solvent of the functional solution through the use of a dry process or the like.

According to this method, it is possible to relatively easily form the patterned conductive thin film, but it is difficult to control the film surface. That is, in the conductive thin film formed by the use of the droplet jetting method, the film surface can be easily disturbed after forming the conductive thin film and such a disturbance remarkably appears in the outer edge portions of the pattern. The electron emission characteristic of the electron emitter having such a conductive thin film is affected by the disturbance of the film surface of the conductive thin film, thereby causing deviation in characteristic within an element and between elements.

SUMMARY

An advantage of the present invention is to provide an electron emitter of which deviation in electron emission characteristic is small and which can be easily manufactured, a method of manufacturing the electron emitter, an electro-optical device having the electron emitter, and an electronic apparatus having the electron emitter.

According to an aspect of the present invention, there is provided a method of manufacturing an electron emitter in which electrons are emitted from an electron emission portion formed in a conductive film, the method comprising: forming the conductive film in a pattern on a substrate by the use of a droplet jetting method; selectively removing a part of the conductive film; and forming the electron emission portion in the conductive film.

In the method of manufacturing an electron emitter according to the present invention, since only a portion with a film surface excellent in flatness of the conductive film formed by the use of the droplet jetting method can be left and used, it is possible to manufacture an electron emitter of which deviation in electron emission characteristic is small.

In the method of manufacturing an electron emitter, the removing of a part of the conductive film may include: forming a dummy functional film in a pattern on the conductive film by the use of the droplet jetting method; and etching an exposed portion of the conductive film by using the dummy functional film as a mask.

According to the method of manufacturing an electron emitter, since the dummy functional film serving as an etching mask is formed by the use of the droplet jetting method, the dummy functional film can be easily formed by the use of the apparatus (droplet jetting apparatus or dry apparatus) common to the film forming process.

In the method of manufacturing an electron emitter, an outer edge portion of the conductive film may be removed in the removing of a part of the conductive film.

According to the method of manufacturing an electron emitter, since the outer edge portion which can easily cause disturbance of the film surface in the conductive film formed by the use of the droplet jetting method is removed, the flatness of the conductive film after the shaping can be improved.

According to another aspect of the present invention, there is provided an electron emitter comprising a conductive film formed on a substrate, in which electrons are emitted from an electron emission portion formed in the conductive film, wherein the conductive film is formed by removing a part of a conductive film formed by the use of a droplet jetting method.

According to the electron emitter of the present invention, since the conductive film includes only a portion with a film surface excellent in flatness of the conductive film formed by the use of the droplet jetting method, the deviation in electron emission characteristic is small.

According to still another aspect of the present invention, there is provided an electro-optical device comprising the electron emitter.

The electro-optical device according to the present invention includes electron emitters formed corresponding to the pixels of a display unit and the display is embodied, for example, by allowing the emitted electrons to collide with fluorescent substances formed on a positive electrode. Since the electron emitters of the electro-optical device include the conductive film with a film surface excellent in flatness, the deviation in electron emission characteristic within an element and between elements is small and it is thus possible to display images with high quality.

According to still another aspect of the present invention, there is provided an electronic apparatus comprising the electron emitter.

Since the electron emitters of the electronic apparatus according to the present invention include the conductive film with a film surface excellent in flatness, the deviation in electron emission characteristic is small and the electronic apparatus can thus provide excellent performance.

BRIEF DESCRIPTION OF THE DRAWINGS

The invention will be described with reference to the accompanying drawings, wherein like numbers reference like elements and wherein.

DESCRIPTION OF THE EXEMPLARY EMBODIMENTS

Figure 1A:
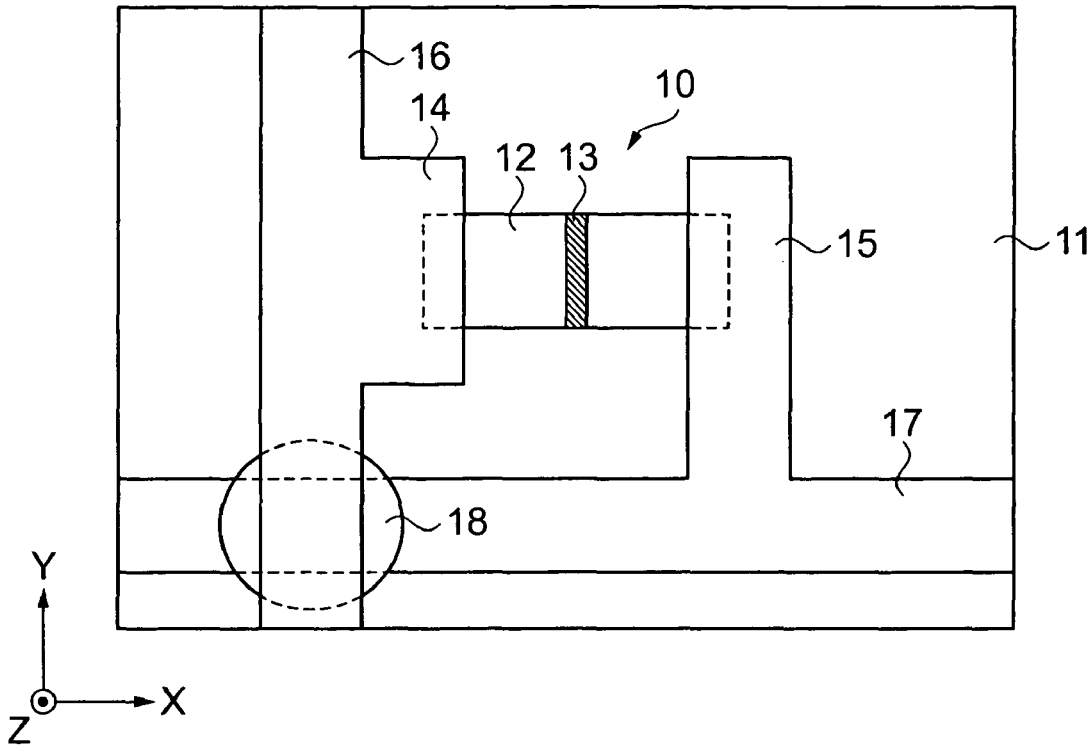
FIG. 1A is a plan view illustrating an electron emitter according to a first embodiment of the present invention and FIG. 1B is a cross-sectional view illustrating the electron emitter according to the first embodiment.

Hereinafter, exemplary embodiments of the present invention will be described in detail with reference to the accompanying drawings.

Since the exemplary embodiments described below are specific examples suitable for the present invention, technically exemplary limitations are attached thereto, but the scope of the present invention is not limited to the embodiments as long as particular intentions of limiting the present invention are not described in the following description. In the drawings referred to by the following description, scales or aspect ratios of layers or elements are different from the real ones, for the purpose of recognizing the layers or elements from the drawings.

First Embodiment (Structure of Electron Emitter)

Figure 1B:
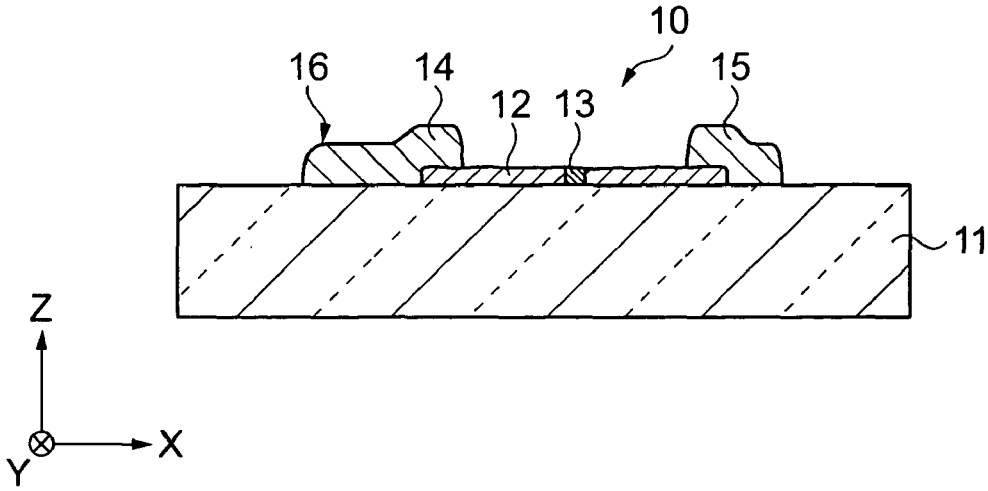

First, a structure of an electron emitter will be described with reference to FIG. 1. FIG. 1 is a diagram illustrating an electron emitter according to a first embodiment of the present invention, wherein FIG. 1A is a plan view of the electron emitter and FIG. 2A is a cross-sectional view of the electron emitter.

In FIG. 1, the electron emitter 10 includes a conductive film 12, a first element electrode 14, and a second element electrode 15 on an element substrate 11. A first signal line 16 and a second signal line 17 for applying drive signals to the element electrodes 14 and 15 are arranged on the element substrate 11 and the signal lines 16 and 17 are electrically isolated from each other by the use of an interlayer insulating film 18. Surroundings of the electron emitter 10 are sealed in high vacuum.

A glass substrate or a ceramic substrate is used as the element substrate 11.

The first element electrode 14 and the second element electrode 15 come in contact with both ends of the conductive film 12, respectively, and have a thickness of several hundreds nm to several μm. Examples of a material of the element electrodes can include metals such as Au, Mo, W, Pt, Ti, Al, Cu, Pd, Ni, and Cr and alloys thereof, and a transparent conductive material such as indium tin oxide (ITO).

The conductive film 12 is a thin film having a thickness of about several angstroms to several thousands angstroms, which extends in the X axis direction and has an electron emission portion 13 (which is schematically shown in the figures) formed as a crack at the center portion thereof. Examples of a material of the conductive film can include metal such as Pd, Pt, Ti, Ru, In, Cu, Cr, Ag, Au, Fe, Zn, Sn, Ta, W, and Pb, oxide such as PdO, $SnO_2$, $In_2O_3$, PbO, and $Sb_2O_3$, boride such as $HfB_2$, $ZrB_2$, $LaB_6$, $CeB_6$, $YB_4$, and $GdB_4$, carbide such as TiC, ZrC, HfC, TaC, SiC, and Wc, nitride such as TiN, ZrN, and HfN, semiconductor such as Si and Ge, carbon, and the like.

In the above-mentioned structure, when a voltage is applied between the element electrodes 14 and 15 through the signal lines 16 and 17, electron conduction occurs in the conductive film 12 over the electron emission portion 13. At this time, a part of the electrons conducted through the crack of the electron emission portion 13 are leaked to vacuum by means of a quantum mechanical effect and the leaked electrons can be used as emitted electrons.

(Structure of Droplet Jetting Apparatus)

Figure 2:
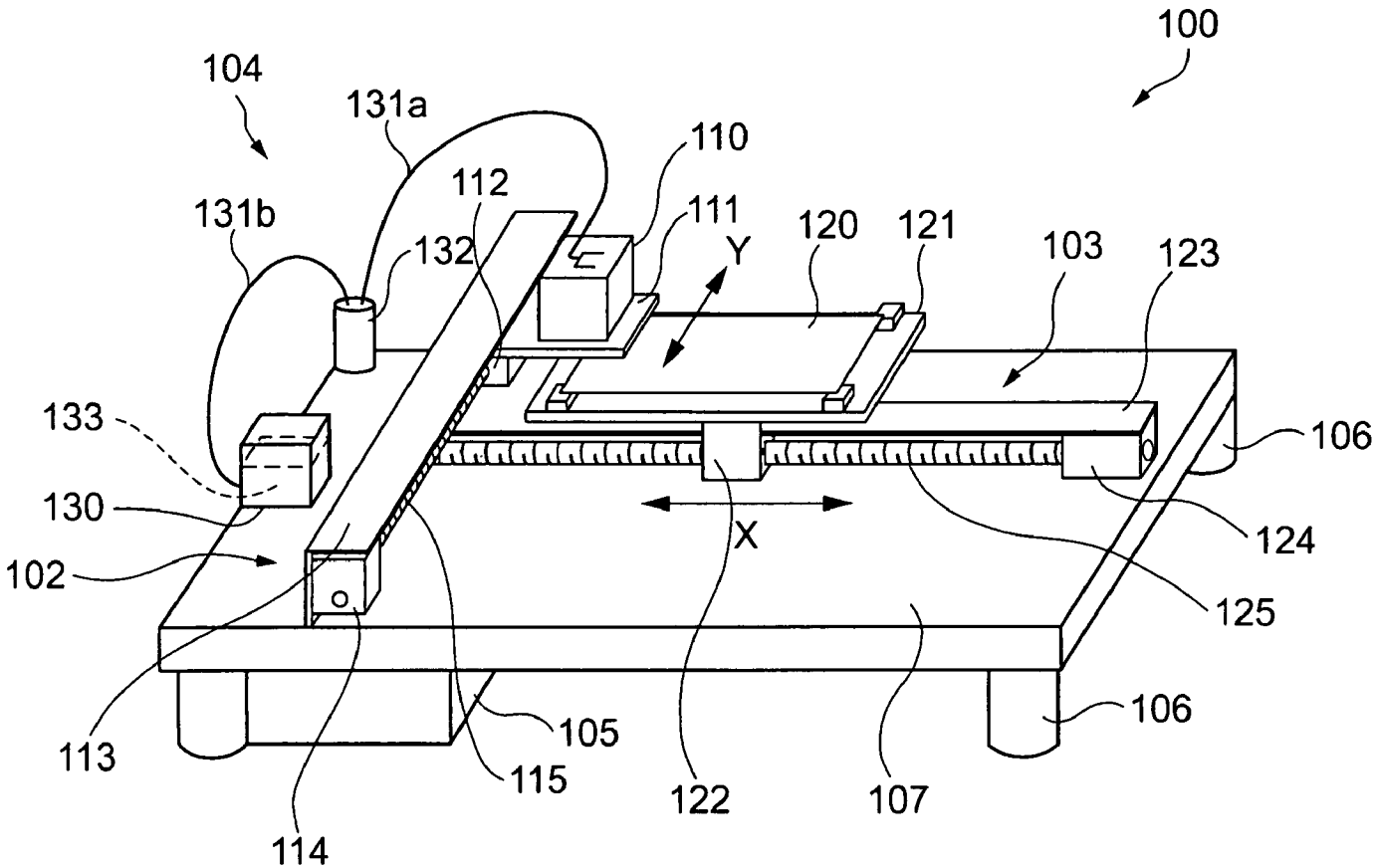
FIG. 2 is a schematic perspective view illustrating an example of a droplet jetting apparatus used for manufacturing the electron emitter.

Next, a structure of a droplet jetting apparatus used for manufacturing the electron emitter 10 will be described with reference to FIG. 2. FIG. 2 is a schematic perspective view illustrating an example of a droplet jetting apparatus used for manufacturing the electron emitter.

As shown in FIG. 2, the droplet jetting apparatus 100 includes a head mechanism section 102 which has a head unit 110 jetting droplets, a substrate mechanism section 103 to be mounted with a substrate 120 as a target of droplets jetted from the head unit 110, a functional solution supply section 104 which supplies a functional solution 133 to the head unit 110, and a controller 105 which totally controls the mechanism sections and the supply section.

The head unit 110 is fitted with a droplet jetting head (not shown) having a plurality of nozzles used for an inkjet printer, is supplied with electrical signals from the controller 105, and then jets the functional solution 133 in a droplet shape. The jetting of droplets can be controlled by the controller 105 in a unit of nozzles.

A glass substrate, a metal substrate, a synthetic resin substrate, or the like can be used as the substrate 120 and most substrates can be used only if they have a flat panel shape. In manufacturing the electron emitter to be described later, the element substrate 11 shown in FIG. 1 is used as the substrate 120.

As the functional solution 133, a solution containing, for example, a filter material for a color filter, a light emitting material or a fluorescent material used for an electro-optical device, a plastic resin material used for forming a bank or a surface coating layer on a surface of a substrate, a conductive material for forming an electrode or a metal line, a resist material, and the like can be prepared corresponding to the purpose of drawing. In manufacturing the electron emitter to be described later, a conductive functional solution for forming the conductive film (see FIG. 1) and the like and a resist solution are used.

The droplet jetting apparatus 100 includes a plurality of support legs 106 provided on a floor and a surface table 107 provided on the support legs 106. The substrate mechanism section 103 is disposed on the surface table 107 in the longitudinal direction (X axis direction) of the surface table 107 and the head mechanism section 102 of which both ends are supported by two pillars fixed to the surface table 107 is disposed on the substrate mechanism section 103 in the direction (Y axis direction) perpendicular to the substrate mechanism section 103. the functional solution supply section 104 which communicates with the head unit 110 of the head mechanism section 102 and serves to supply the functional solution 133 is disposed on one end of the surface table 107.

The head mechanism section 102 includes the head unit 110 which jets the functional solution 133, a carriage 111 which is mounted with the head unit 110, a Y axis guide 113 which guides movement of the carriage 111 in the Y axis direction, a Y axis ball screw which is disposed along the Y axis guide 113, a Y axis motor 114 which allows the Y axis ball screw 115 to positively and negatively rotate, and a carriage screw-coupling portion 112 which has a female screw portion formed under the carriage 111, wherein the female screw portion is screw-coupled to the Y axis ball screw 115 and serves to move the carriage 111.

The movement mechanism of the substrate mechanism section 103 is disposed in the X axis with almost the same structure as the head mechanism section 102. That is, the substrate mechanism section 103 includes a platform 121 which is mounted with the substrate 120, an X axis guide 123 which guides the movement of the platform 121, an X axis ball screw 125 which is disposed along the X axis guide 123, an X axis motor 124 which allows the X axis ball screw 125 to positively and negatively rotate, and a platform screw-coupling portion 122 which is screw-coupled to the X axis ball screw 125 under the platform 121 and serves to move the platform 121.

The functional solution supply section 104 supplying the functional solution 133 to the head unit 110 includes a tube 131*a* forming a flow path communicating with the head unit 110, a pump 132 feeding a liquid to the tube 131*a*, a tube 131*b* (flow path) feeding the functional solution 133 to the pump 132, and a tank 130 communicating with the tube 131*b* and storing the functional solution 133. The functional solution supply section is disposed at one end on the surface table 107.

In the above-mentioned structure, the head unit 110 can freely and relatively move in the Y axis direction with respect to the substrate 120 and can place the droplets jetted from the head unit 110 at any position on the substrate 120. Then, by performing the position control and the jetting control in a unit of nozzles in the head unit 110 in synchronism with each other, it is possible to place (draw) the functional solution 133 in a predetermined pattern on the substrate 120.

Although it has been shown in FIG. 2 that the functional solution supply section 104 supplies a kind of functional solution to the head unit 110, the functional solution supply section can substantially supply plural kinds of functional solutions at a time and the head unit 110 can jet the plural kinds of functional solutions at the same time.

(Method of Manufacturing Electron Emitter)

Figure 3:
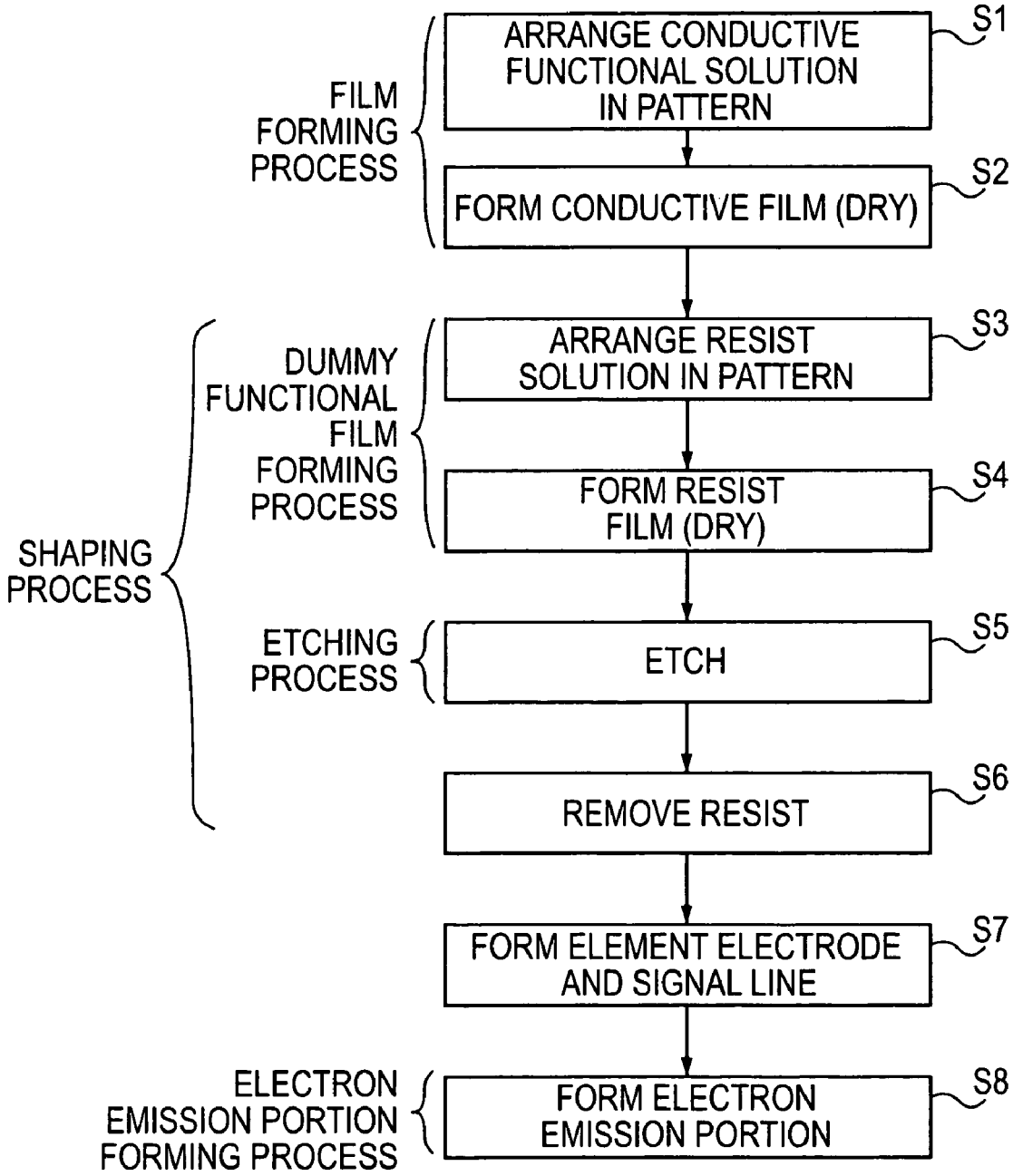
FIG. 3 is a flowchart illustrating a method of manufacturing the electron emitter according to the first embodiment.

Next, a method of manufacturing an electron emitter will be described with reference to FIG. 4 on the basis of a flowchart shown in FIG. 3. FIG. 3 is a flowchart illustrating a method of manufacturing the electron emitter according to the first embodiment of the present invention. FIGS. 4A to 4F are schematic cross-sectional views illustrating one step of the method of manufacturing the electron emitter according to the first embodiment, respectively.

Figure 4A:
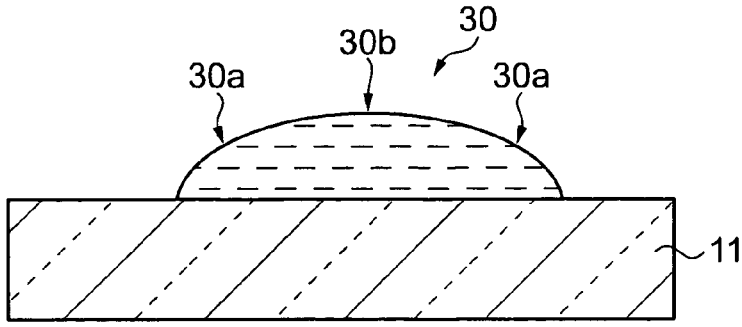
FIGS. 4A to 4F are schematic cross-sectional views illustrating one step of the method of manufacturing the electron emitter according to the first embodiment, respectively.

First, as shown in FIG. 4A, a conductive functional solution 30 are arranged in a pattern on the element substrate 11 by the use of the droplet jetting apparatus 100 shown in FIG. 2 (step S1 of FIG. 3 which constitutes a film forming process). Here, a solution in which conductive particulates are dispersed in a dispersion medium is used as the conductive functional solution 30.

The conductive particulates are obtained by graining the above-mentioned material for the conductive film 12 into particulates and the surfaces thereof may be coated with an organic material for use in order to improve a dispersion property. Water, alcohols, hydrocarbon compounds, ether compounds, or the like can be used as the dispersion medium and the vapor pressure of the dispersion medium is preferably in the range of 0.1 Pa to 27 kPa, from the view point of a dry speed at the time of film formation or a storage stability when the functional solution is stored in the droplet jetting apparatus 100. The surface tension of the conductive functional solution 30 is preferably in the range of 0.02 N/m to 0.07 N/m, from the view point of jetting stability, and may be adjusted by adding a surface active agent thereto. A resin for improving a fixing property after film formation or various additives for adjustment of viscosity and storage stability can be properly added to the conductive functional solution 30.

As a pre-treatment before drawing, lyophilic and lyophobic surface treatments (for example, film formation using a plasma process or surface adsorbing molecules) may be performed or patterns may be partitioned by barrier walls referred to as banks, correspondingly to desired patterns. By performing such a pre-treatment, it is possible to place the conductive functional solution 30 in a desired pattern with higher accuracy.

Figure 4B:
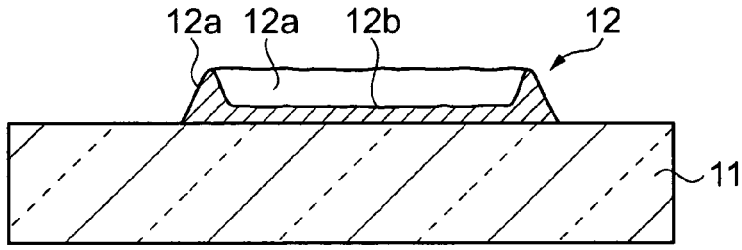

After placing the conductive functional solution 30 in a desired pattern, as shown in FIG. 4B, the dispersion medium of the conductive functional solution 30 is removed through a dry or baking process, thereby form the conductive film 12 (step S2 of FIG. 3 constituting the film forming process). At this time, the conductive film 12 is formed such that the film surface at the center portion 12*b* thereof is relatively flat and the film surface at the outer edge portion 12*a* thereof is raised to form an outer ring. As shown in FIG. 4A, this is, it is considered, because the dry speeds at the center portion 30*b* and the outer edge portion 30*a* are different from each other due to the curved surface of the conductive functional solution 30 and thus non-uniformity in concentration of the conductive particulates are generated due to an internal convection.

In this way, since the conductive film 12 formed by the use of the droplet jetting method has a largely disturbed film surface specifically at the outer edge portion 12*a*, it is preferable that such disturbance of the film surface is excluded through a shaping process described below.

The shaping process approximately includes a dummy functional film forming process and an etching process.

Figure 4C:
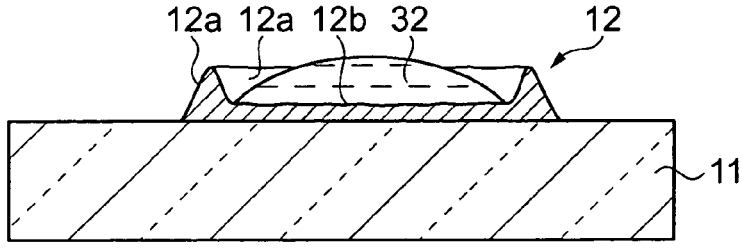
Figure 4D:
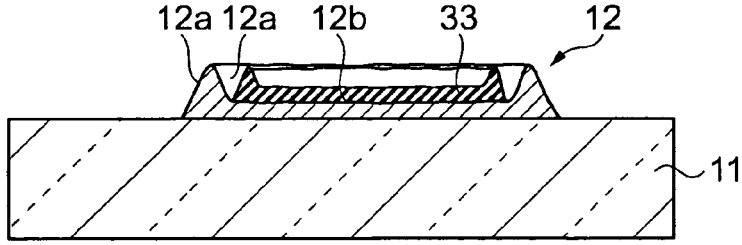

First, as shown in FIG. 4C, a resist solution 32 is arranged in a pattern on the center portion 12*b* of the conductive film 12 by the use of the droplet jetting apparatus 100 shown in FIG. 2 (step S3 of FIG. 3 which constitutes the dummy functional film forming process). Next, as shown in FIG. 4D, a resist film 33 as a dummy functional film is formed by drying the resist solution 32 (step S4 of FIG. 3 which constitutes the dummy functional film forming process). The resist film 33 serves to mask the conductive film 12 and is also formed in other places on the element substrate 11 as needed (for example, when electrodes and the like are formed in advance).

Figure 4E:
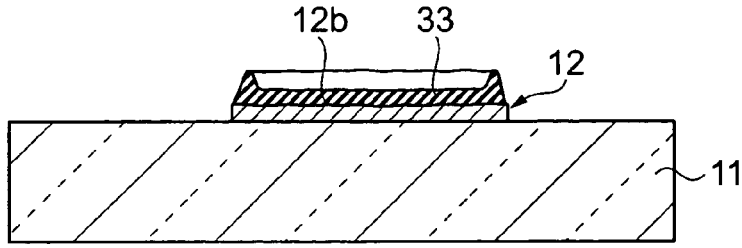
Figure 4F:
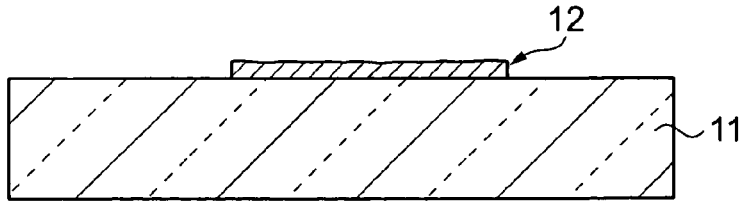

Next, as shown in FIG. 4E, an outer edge portion 12*a* of the conductive film 12 is etched by using the resist film 33 as a mask (step S5 of FIG. 3 which constitutes an etching process) and then as shown in FIG. 4F, the resist film 33 is removed (step S6 of FIG. 3). The etching process is performed by the use of a wet etching method, a dry etching method, an electrolysis etching method, or the like. Since the resist film 33 serving as an etching mask is formed by the use of the droplet jetting method, the resist film can be easily formed by the use of the apparatus (droplet jetting apparatus 100 or dry apparatus) common to the film forming process (steps S1 and S2).

As described above, the conductive film 12 with a film surface excellent in flatness is formed on the element substrate 11 through the film forming process of steps S1 and S2 and the shaping process of steps S3 to S6.

Finally, the element electrodes 14 and 15, the signal lines 16 and 17, and the interlayer insulating film 18 are formed in patterns (step S7 of FIG. 3) and the electron emission portion 13 is formed in the conductive film 12 through an electrification forming method (step S8 of FIG. 3 as an electron emission portion forming process), thereby completing the electron emitter 10 shown in FIG. 1.

In this way, the conductive film 12 according to the present embodiment is formed slightly larger than the completed conductive film and then the outer edge portion 12*a* having a disturbed film surface is removed. Accordingly, since the film surface of the conductive film 12 has excellent flatness, it is possible to provide an electron emitter 10 with small deviation in electron emission characteristic.

(Structure of Electro-optical Device)

Figure 5A:
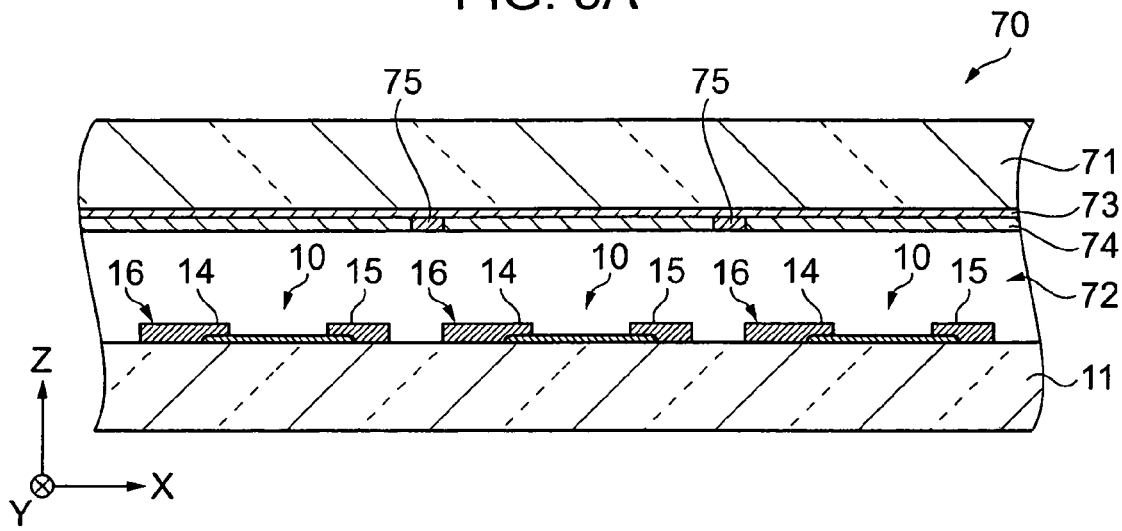
FIG. 5A is a schematic cross-sectional view illustrating a structure of an important part of an electro-optical device and FIG. 5B is a schematic plan view illustrating a layout of electron emitters on an element substrate.

Next, a structure of an electro-optical device will be described with reference to FIG. 5. FIG. 5A is a schematic cross-sectional view illustrating a structure of an important part of an electro-optical device and FIG. 5B is a schematic plan view illustrating a layout of electron emitters on an element substrate.

In FIG. 5A, an electro-optical device 70 includes an element substrate 11 on which the electron emitters 10 are arranged and a display substrate 71 opposed to the element substrate 11. The element substrate 11 and the display substrate 71 are apart by a constant distance from each other by external frame members not shown and the space 72 between both substrates 11 and 71 is sealed in vacuum with $10^{-7}$ Torr. Here, in order to maintain the degree of vacuum, a gas adsorbing film not shown may be formed on the surface facing the space 72.

Figure 5B:
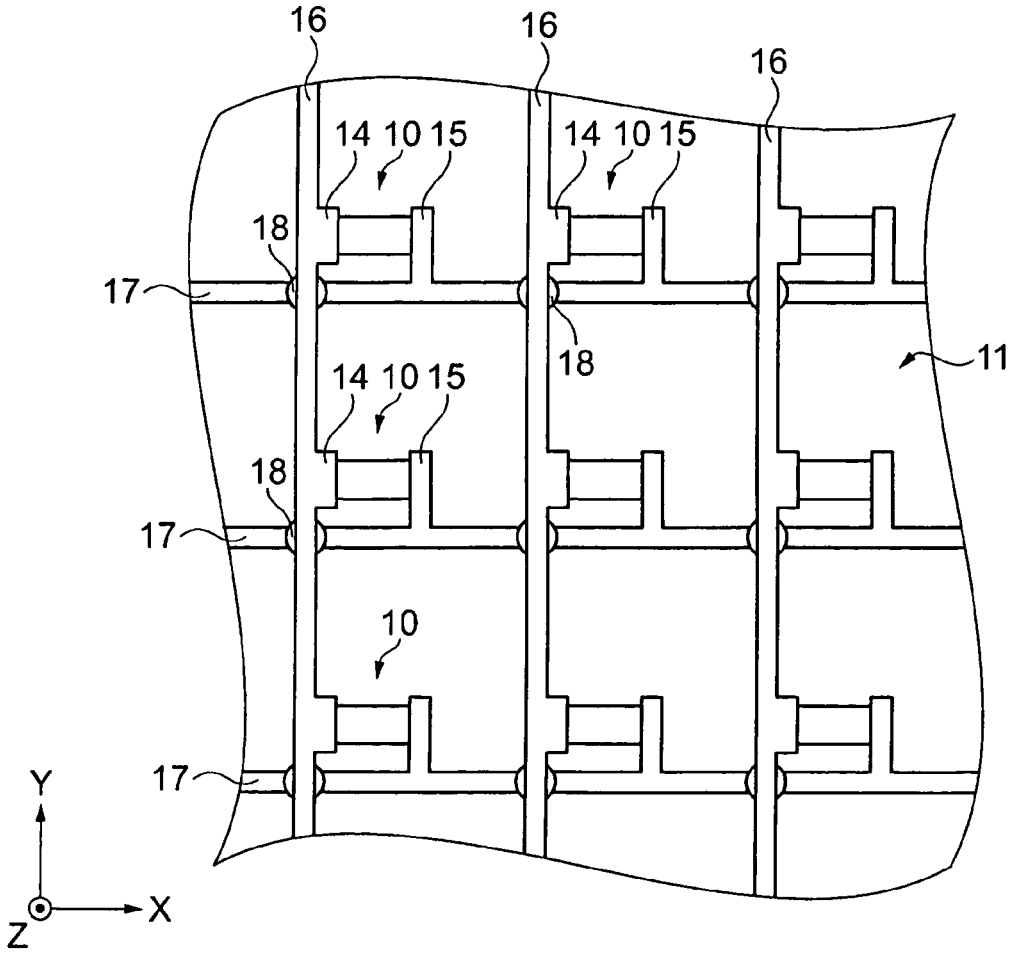

As shown in FIG. 5B, the element substrate 11 includes first signal lines 16 and second signal lines 17 which are arranged in a matrix shape, first element electrodes 14 and second element electrodes 15 which are formed along both signal lines 16 and 17, and an arrangement in which the electron emitters 10 are arranged in a unit of pixels. The first signal lines 16 and the second signal lines 17 are electrically isolated from each other by an interlayer insulating film 18 made of an insulating material and are supplied with different signals, respectively. That is, the second signal lines 17 are supplied with a scan signal for driving the electron emitters 10 sequentially by one row (line in the X axis direction of the figure) and the first signal lines 16 are supplied with a gray-scale signal for controlling electron emission of the electron emitters 10 in the row selected by the scan signal, thereby controlling the electron emission in a unit of pixels.

In FIG. 5A, the display substrate 71 includes a counter electrode 73, a fluorescent film 74, and a light-shielding film 75. The light-shielding film 75 is formed corresponding to the arrangement of the electron emitters 10 so as to partition the pixels and serves to reduce crosstalk between the pixels or reflection of external light from the fluorescent film 74. The light-shielding film may be made of a material having conductivity and light-shielding property such as graphite or the like.

The fluorescent film 74 contains fluorescent substances and serves to turn on the pixels by allowing the fluorescent substances to emit light by means of collision of the electrons emitted from the electron emitters 10 therewith. When the electro-optical device 70 is a color display type, the fluorescent film 74 is divided and formed into fluorescent substances corresponding to the three primary colors every pixel.

The counter electrode 73 is supplied with an acceleration voltage (for example, about 10 kV) and serves to accelerate the emitted electrons so as to give sufficient energy for exciting the fluorescent substances of the fluorescent film 74. The counter electrode 73 may be made of a transparent conductive material such as ITO or the like.

In the above-mentioned structure, the scan signals supplied to the second signal lines 17 and the gray-scale signals supplied to the first signal lines 16 are controlled to emit the electrons from the electron emitters 10 and the emitted electrons accelerated by the counter electrode 73 collide with the fluorescent film 74 to turn on the pixels, thereby displaying a desired image. Since the electro-optical device 70 has the electron emitters 10 described above, the irradiation accuracy of the emitted electrons is excellent and it is thus possible to display an image with high accuracy.

(Electronic Apparatus)

Figure 6:
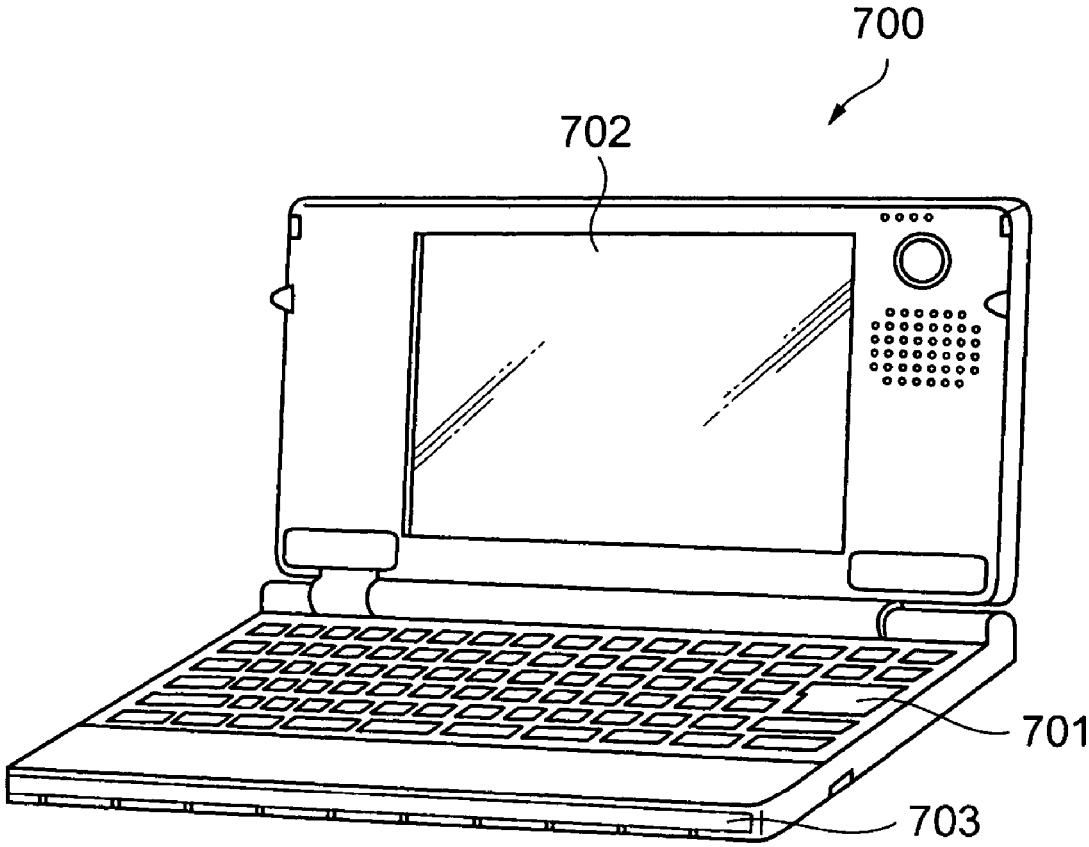
FIG. 6 is schematic perspective view illustrating an example of an electronic apparatus.

Next, a specific example of an electronic apparatus will be described with reference to FIG. 6. FIG. 6 is a schematic perspective view illustrating an example of an electronic apparatus.

A portable information processing apparatus 700 as an electronic apparatus shown in FIG. 6 includes a keyboard 701, an information processing apparatus body 703, and an electro-optical device 702. More specific examples of such a portable information processing apparatus 700 can include a word processor and a personal computer (PC). Since the portable information processing apparatus 700 includes the electro-optical device 72 having the electron emitters 10 described above, the irradiation accuracy of the emitted electrons is excellent and it is thus possible to display an image with high quality.

Other examples of the electronic apparatus including the electron emitters 10 can include a variety of apparatuses employing the electron emitters 10 as a coherent electron source, such as a coherent electron beam convergence apparatus, an electron beam holography apparatus, a monochromatic electron gun, an electron microscope, a multi coherent electron beam generating apparatus, an electron beam exposure apparatus, and a patterning apparatus of an electro-photograph printer.

Second Embodiment

Next, a second embodiment of the present invention will be described with reference to FIGS. 8 and 9 on the basis of a flowchart shown in FIG. 7. Hereinafter, details equal to those of the above-mentioned embodiment are not described again but details different from those of the above-mentioned embodiment are mainly described.

Figure 7:
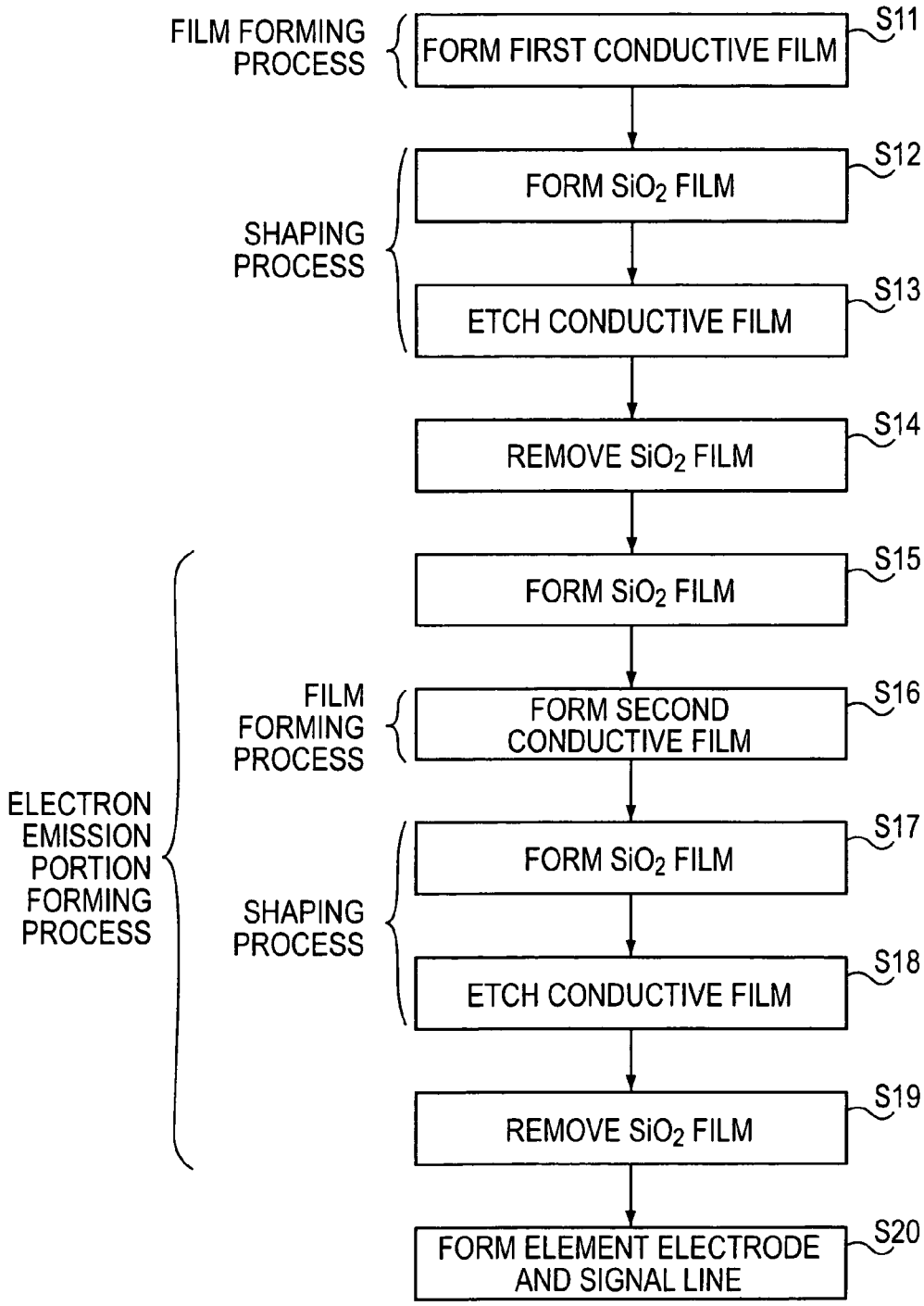
FIG. 7 is a flowchart illustrating a method of manufacturing an electron emitter according to a second embodiment of the present invention.

FIG. 7 is a flowchart illustrating a method of manufacturing an electron emitter according to a second embodiment. FIGS. 8A to 8E and FIGS. 9F to 9I are schematic cross-sectional views illustrating one step of the method of manufacturing an electron emitter according to the second embodiment, respectively.

Figure 8A:
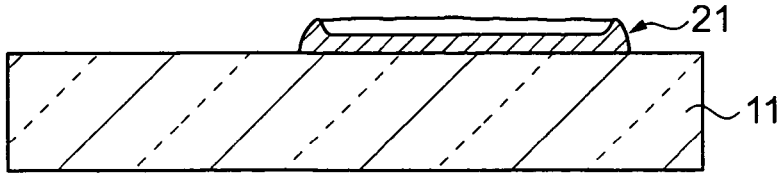
FIGS. 8A to 8E are schematic cross-sectional views illustrating one step of the method of manufacturing the electron emitter according to the second embodiment, respectively.
Figure 8B:
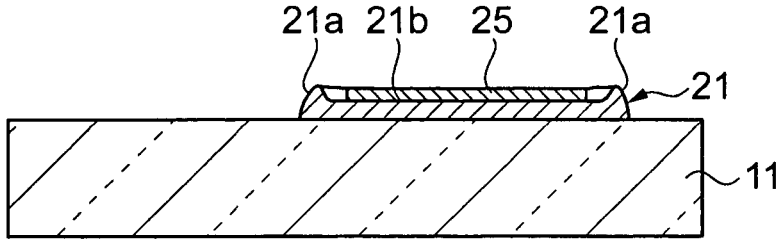

In the second embodiment, first, as shown in FIG. 8A, a first conductive film 21 is formed in a pattern on the element substrate 11 by the use of the droplet jetting method (step S11 of FIG. 7 as a film forming process). Next, as shown in FIG.

Figure 8C:
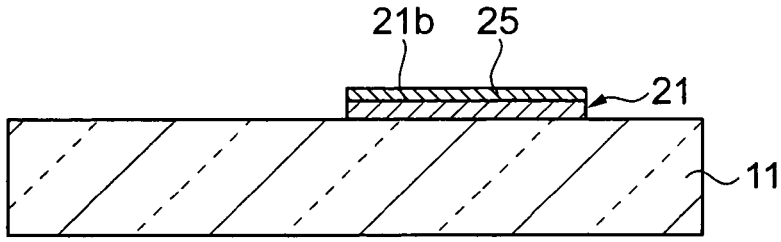

8B, an $SiO_2$ film 25 as a dummy functional film is formed in a pattern on the center portion 21*b* of the first conductive film 21 (step S12 of FIG. 7) and as shown in FIG. 8C, the outer edge portion 21*a* of the first conductive film 21 is etched by using the $SiO_2$ film 25 as a mask (step S13 of FIG. 7), thereby shaping the first conductive film.

In this way, the material of the dummy functional film in the shaping process is not limited to the resist material, but any material may be used only if it can function as an etching mask in the etching process.

Figure 8D:
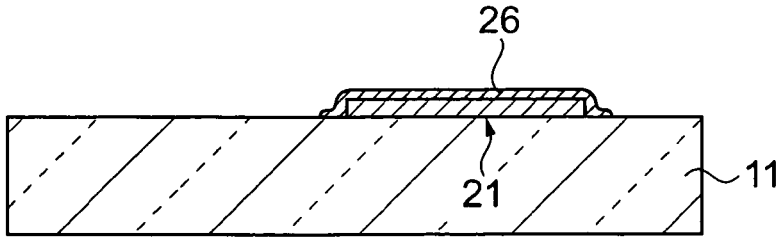
Figure 8E:
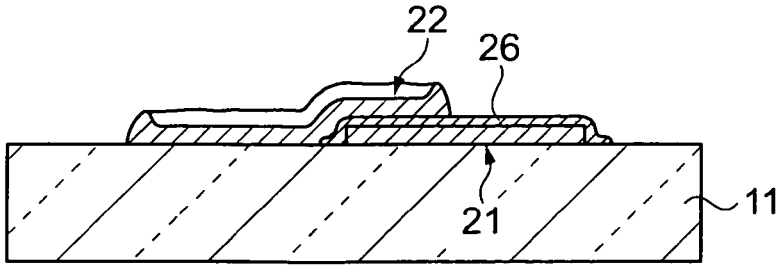

Next, the $SiO_2$ film 25 is once removed through the etching process with an HF solution or the like (step S14 of FIG. 7) and then as shown in FIG. 8D, an $SiO_2$ film 26 is formed as a micro thin film with a thickness of about 1 nm to 50 nm to cover the whole surface of the first conductive film 21 (step S15 of FIG. 7). Then, as shown in FIG. 8E, a second conductive film 22 is formed to overlap with the first conductive film 21 with the $SiO_2$ film 26 therebetween (step S16 of FIG. 7).

The $SiO_2$ film 26 formed here is not a functional film serving as a mask like the $SiO_2$ film 25 described above, but serves to form a narrow gap defined by the thickness of the $SiO_2$ film 26 between the conductive films 21 and 22.

Figure 9F:
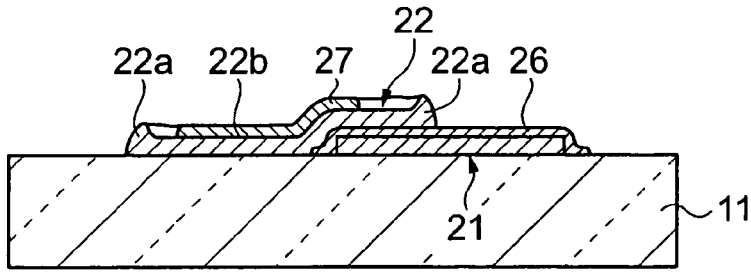
FIGS. 9F to 9I are schematic cross-sectional views illustrating one step of the method of manufacturing the electron emitter according to the second embodiment.
Figure 9G:
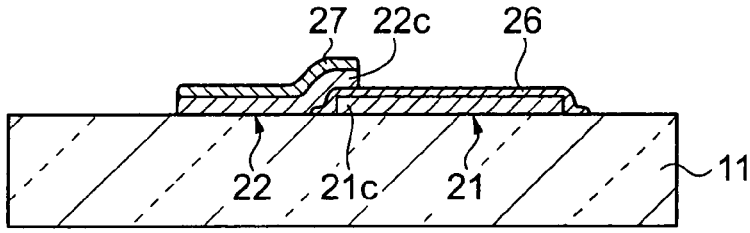
Figure 9H:
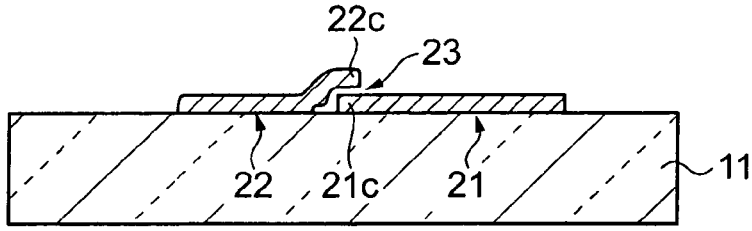
Figure 9I:
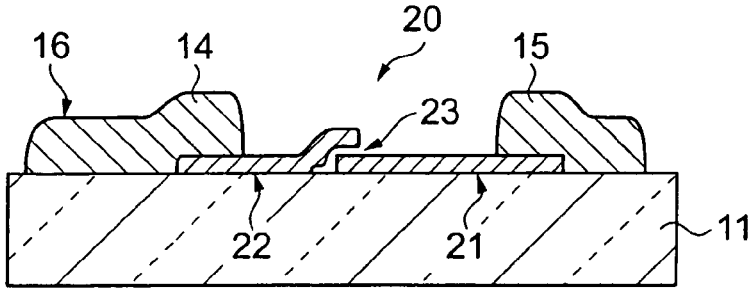

Next, as shown in FIG. 9F, a $SiO_2$ film 27 as a dummy functional film is formed in a pattern on the second conductive film 22 (step S17 of FIG. 7) and a part of the outer edge portion 22*a* and the center portion 22*b* of the second conductive film 22 is etched by using the $SiO_2$ film 27 as a mask (step S18 of FIG. 7). In this way, as shown in FIG. 9G, a structure that the new outer edge portion 21*c* of the first conductive film 21 and the new outer edge portion 22*c* of the second conductive film 22 are opposed to each other with the $SiO_2$ film 26 therebetween is obtained. Then, as shown in FIG. 9H, by removing the $SiO_2$ film 26 and the $SiO_2$ film 27 (step S19 of FIG. 7), a narrow gap is formed at the portion corresponding to the opposed structure and serves as an electron emission portion 23. Finally, as shown in FIG. 9I, the electron electrodes 14 and 15 and the signal lines 16 and 17 are formed in patterns (step S20 of FIG. 7), thereby completing an electron emitter 20.

In this way, the film forming process and the shaping process may be separately performed several times and the electron emission portion forming process, the film forming process, and the shaping process may be performed in an overlapping manner.

The present invention is not limited to the above-mentioned embodiments. For example, in the shaping process (steps S3 to S6 in FIG. 3) of the first embodiment, the etching of the outer edge portion 12*a* of the conductive film 12 may be performed only to a part (for example, a portion where the electron emission portion 13 is formed) of the outer edge portion, not to the entire outer edge portion.

In the first embodiment, the electron emitter may be formed through the use of a forming process with electron beams or a local polishing process, instead of the electrification forming process.

In the first embodiment, the electron emission portion may be formed at the time after the film forming process and before the shaping process.

The elements of the respective embodiments may be combined or omitted properly, or may be combined with other elements not shown.

What is claimed is:

1. A method of manufacturing an electron emitter in which electrons are emitted from an electron emission portion formed in a first conductive film, the method comprising:

forming the first conductive film in a pattern on a substrate by the use of a droplet jetting method;

selectively removing a part of the first conductive film;

forming the electron emission portion in the first conductive film, wherein the removing of a part of the first conductive film includes:

forming a first dummy functional film in a pattern on the first conductive film by the use of the droplet jetting method; and etching an exposed portion of the first conductive film by using the first dummy functional film as a mask;

forming a second dummy functional film on the first conductive film;

forming a second conductive film partially overlapping the second dummy functional film and the first conductive film; and removing the second dummy functional film to form a gap between the first conductive film and the second conductive film, wherein the gap includes the electron emission portion.

2. The method of manufacturing an electron emitter according to claim 1 wherein in the removing of a part of the first conductive film, an outer edge portion of the first conductive film is removed.

* * * * *